US011022113B2

(12) United States Patent
Sauter

(10) Patent No.: US 11,022,113 B2
(45) Date of Patent: Jun. 1, 2021

(54) CONNECTION ASSEMBLY WITH FEED PUMP AND ELASTIC ELEMENT

(71) Applicant: Robert Bosch GmbH, Stuttgart (DE)

(72) Inventor: Michael Sauter, Bibertal (DE)

(73) Assignee: Robert Bosch GmbH, Stuttgart (DE)

( * ) Notice: Subject to any disclaimer, the term of this patent is extended or adjusted under 35 U.S.C. 154(b) by 111 days.

(21) Appl. No.: 16/419,386

(22) Filed: May 22, 2019

(65) Prior Publication Data

US 2019/0360484 A1 Nov. 28, 2019

(30) Foreign Application Priority Data

May 23, 2018 (DE) ..... 10 2018 208 068.2

(51) Int. Cl.

| | |
|---|---|
| ***F04C 2/10*** | (2006.01) |
| ***F04C 15/00*** | (2006.01) |
| ***F04C 2/344*** | (2006.01) |
| ***F04C 2/08*** | (2006.01) |
| ***F04B 23/12*** | (2006.01) |

(52) U.S. Cl.

CPC ..... *F04C 2/102* (2013.01); *F04B 23/12* (2013.01); *F04C 2/086* (2013.01); *F04C 2/344* (2013.01); *F04C 15/0003* (2013.01); *F04C 15/0023* (2013.01)

(58) Field of Classification Search

CPC ..... F04C 15/0003; F04C 2/086; F04C 2/102

See application file for complete search history.

(56) References Cited

U.S. PATENT DOCUMENTS 5,085,187 A * 2/1992 Black ..... F04C 14/265 123/196 R
7,318,422 B2 * 1/2008 Douyama ..... F04C 2/086 123/495

(Continued)

FOREIGN PATENT DOCUMENTS

DE 41 02 162 A1 7/1992
DE 199 13 774 A1 10/2000

(Continued)

OTHER PUBLICATIONS

German Search Report corresponding to German Application No. 10 2018 208 068.2, dated Feb. 8, 2019 (German language document) (10 pages).

*Primary Examiner* — Mary Davis
(74) *Attorney, Agent, or Firm* — Maginot, Moore & Beck LLP

(57) ABSTRACT

A connection assembly for use in an axial piston machine has a feed pump and a main body. The main body is equipped with at least one fluid connection. The feed pump is configured as an internal gear pump or as a vane-type pump. A pump assembly defines a planar sealing surface which bears at least indirectly against the main body. The main body has a second recess in which the pump assembly is received at least in certain portions. A separate cover is provided which covers the second recess and the pump assembly in each case at least in certain portions. The cover bears against the main body. An elastic element is installed under preload between the cover and the receiving part such that a corresponding preload force is supported at least indirectly on the main body via the sealing surface.

12 Claims, 7 Drawing Sheets

(56) References Cited

U.S. PATENT DOCUMENTS

| | | | | |
|---|---|---|---|---|
| 8,187,128 | B2 * | 5/2012 | Mack | F16H 7/1218 474/138 |
| 2006/0051229 | A1 | 3/2006 | Thoms et al. | |
| 2014/0178236 | A1 * | 6/2014 | Uchiyama | F04C 2/086 418/191 |
| 2016/0305427 | A1 * | 10/2016 | Welte | F04C 15/00 |

FOREIGN PATENT DOCUMENTS

| | | |
|---|---|---|
| DE | 10 2007 011 644 B4 | 9/2007 |
| DE | 10 2015 213 387 A1 | 1/2017 |
| DE | 10 2016 121 237 A1 | 5/2018 |
| DE | 10 2017 213 457 A1 | 2/2019 |

* cited by examiner

CONNECTION ASSEMBLY WITH FEED PUMP AND ELASTIC ELEMENT

This application claims priority under 35 U.S.C. § 119 to patent application number DE 10 2018 208 068.2, filed on May 23, 2018 in Germany, the disclosure of which is incorporated herein by reference in its entirety.

BACKGROUND

The disclosure relates to a connection assembly as per the following description.

DE 10 2007 011 644 B4 has disclosed an axial piston machine having a connection assembly which comprises a feed pump. The connection assembly is designed such that only a small number of parts have to be changed in order to adapt the connection assembly to feed pumps with different delivery capacities.

An advantage of the present disclosure consists in that even fewer parts have to be changed in order to adapt the connection assembly to feed pumps with different delivery capacities. Specifically, no changes need to be made to the cover, and/or intermediate rings provided there can be omitted. Furthermore, the connection assembly is completely leak-tight in the region of the feed pump even if parts with unfavorable dimensions are combined with one another within the manufacturing tolerance.

According to the following description, it is proposed that an elastic element is installed under preload between the cover and the receiving part such that a corresponding preload force is supported at least indirectly on the main body via the sealing surface. The stated parts of the pump assembly preferably jointly define the sealing plane. The stated preload force is, in the region of the receiving part and/or of the outer part, supported on the main body preferably in static fashion. In the region of the inner part, the preload force is supported on the main body preferably by means of the hydrostatic forces that arise during operation, wherein, in the standstill state, substantially no force is supported by the inner part. The force acting on the pump assembly via the sealing surface in the direction of the axis of rotation is preferably supported exclusively via the elastic element. It is preferable for the receiving part and the cover to be arranged with a spacing to one another across their entire extent. The outer part and the inner part bear preferably sealingly against the base of the first recess or against a closure plate arranged there. The first and/or the second recess are preferably each of circular cylindrical design and arranged parallel to the axis of rotation. It is preferable for the first and the second recess to be arranged eccentrically with respect to one another.

Advantageous refinements and improvements of the disclosure are specified in the following description.

SUMMARY

Provision may be made for the elastic element to be formed as a separate component. The receiving part and/or the cover are formed so as to be substantially rigid in relation thereto, wherein these are preferably composed of metal, in particular steel, cast iron or aluminum. The preload force of the elastic element can thus be easily set such that no leaks occur in the region of the sealing surface. In particular, it is also possible to realize high preload forces, such that the elastic element can accommodate even high hydraulic forces. The elastic element is preferably composed of steel, most preferably of hardened spring steel.

Provision may be made for the elastic element to be formed as a single piece. It can thus be produced particularly easily. It is preferably envisaged for the elastic element to be bent from a wire or punched from a metal sheet.

Provision may be made for the elastic element to annularly surround the axis of rotation. Said elastic element is preferably in the form of a circular ring. Its outer ring diameter amounts to preferably between 80% and 95% of the outer diameter of the receiving part. The dimensions of the elastic element are thus configured to be as large as possible. The elasticity of the elastic element can thus be easily adjusted, wherein said elastic element can simultaneously transmit high forces.

Provision may be made for the elastic element to be formed in the manner of an ondular washer. The elastic element preferably has a constant, for example rectangular, cross-sectional shape over its circumference. Said elastic element runs along its circumference, preferably in undulating bent fashion.

Provision may be made for the elastic element to be formed so as to be discontinuous in a circumferential direction. Said elastic element accordingly has the form of a slotted ring. This yields a defined stiffness of the elastic element, which is defined exclusively by the bending stiffness, which is easy to determine by calculation, of the individual undulating portions.

Provision may be made for the elastic element to be received in a groove, which runs in encircling fashion annularly around the axis of rotation, in the receiving part. The position of the elastic element transversely with respect to the axis of rotation is thus defined in form-fitting fashion. The preload force acts centrally on the receiving part, such that there is no risk of said receiving part becoming jammed in the second recess or the mobility of said receiving part being impeded in some other way.

Provision may be made for the depth of the groove measured in the direction of the axis of rotation to be smaller than the corresponding height of the unbraced elastic element. Said depth is preferably also smaller than the corresponding height of the elastic element in the fully assembled state. It is achieved in this way that the cover bears exclusively against the elastic element but not against the receiving part.

Provision may be made for the pump assembly to bear via a separate closure plate against the main body, wherein the closure plate has at least two apertures which open out in each case between the inner part and the outer part, wherein the closure plate is connected rotationally conjointly to the main body, wherein at least one aperture is fluidically connected to an associated fluid connection. The closure plate is preferably formed as a planar plate of constant thickness. The apertures are preferably of kidney-shaped form. The closure plate is preferably composed of brass or of coated steel, in particular of manganese-phosphated steel.

Provision may be made for an outer circumferential surface of the closure plate and an outer circumferential surface of the receiving part to be formed in alignment with one another in the direction of the axis of rotation. Said outer circumferential surfaces are preferably of circular cylindrical form with respect to the axis of rotation.

Provision may be made for at least one aperture to be assigned a third recess which is arranged on the base of the first recess. Additional pressure equalization between the individual pressure chambers of the feed pump is achieved in this way. The apertures in the closure plate already give rise to similar pressure equalization. The circumferential shape of the third recesses is, preferably as viewed in the direction of the axis of rotation, formed so as to be congruent with the circumferential shape of the respectively associated aperture in the closure plate.

Protection is also asserted for a collection which comprises at least two connection assemblies according to the disclosure, wherein the main bodies, the covers and the drive shaft of all connection assemblies are of identical form, wherein the outer parts and the inner parts of the various connection assemblies differ, wherein an external shape of the receiving part is of identical form in all connection assemblies, wherein an internal shape of the receiving part is of different form in the various connection assemblies. The outer parts and the inner parts of the various connection assemblies preferably differ with regard to the width measured in the direction of the axis of rotation.

It is self-evident that the features mentioned above and the features yet to be discussed below may be used not only in the respectively specified combination but also in other combinations or individually without departing from the scope of the present disclosure.

BRIEF DESCRIPTION OF THE DRAWINGS

The disclosure will be discussed in more detail below on the basis of the appended drawings, in which.

DETAILED DESCRIPTION

Figure 1:
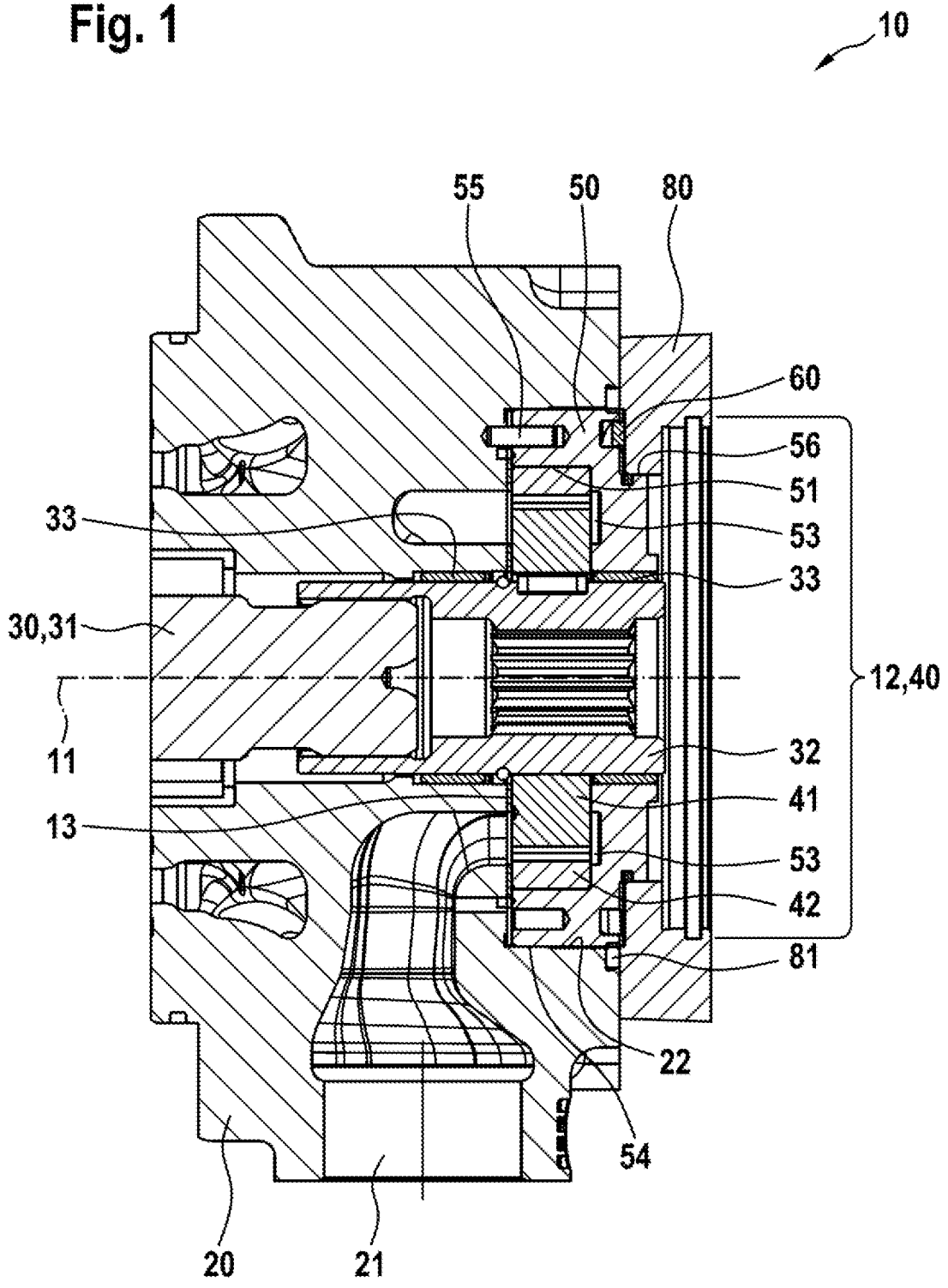
FIG. 1 shows a longitudinal section of a connection assembly according to the disclosure.

FIG. 1 shows a longitudinal section of a connection assembly 10 according to the disclosure. The connection assembly 10 is provided for use in the axial piston pump as per the German patent application with the file reference 102017213457.7. The entire content of said patent application is referred to and incorporated into the content of the present application. The connection assembly 10 is, in the cited patent application, referred to as "housing cover", wherein the term "connection plate" is also common.

Figure 7:
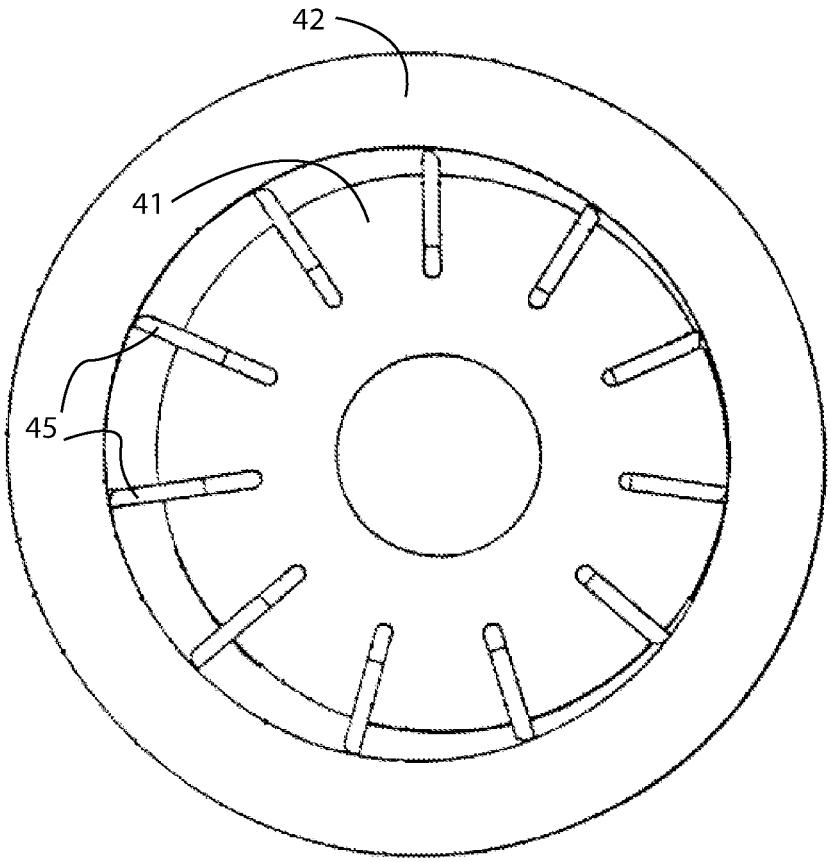
FIG. 7 shows a block diagram of a vane pump including an inner part and an outer part.

The connection assembly 10 comprises a main body 20, which is produced for example in a casting process. The main body 20 forms at least one fluid connection 21, wherein, in FIG. 1, only the suction connection is visible, whereas the pressure connection is not visible. In the direction of an axis of rotation 11, the main body 20 is extended through by a drive shaft 30, which in the present case comprises a first and a second shaft part 31; 32, which shaft parts are connected to one another rotationally conjointly with respect to the axis of rotation 11 for example by means of a spline toothing, a parallel-key driving arrangement or a hexagonal connection. The first shaft part 31 bears the cylinder drum of the axial piston machine, wherein the second shaft part 32 bears the feed pump 40. The feed pump 40 is, in the present case, in the form of an internal gear pump, wherein it may also be in the form of a vane-type pump. In both cases, the feed pump comprises an inner part 41, which is connected rotationally conjointly to the drive shaft 30. The inner part 41 is annularly surrounded by an outer part 42. Between the inner part 41 and the outer part 42, there are multiple pressure chambers, the volume of which changes when the drive shaft 30 rotates. In the case of an internal gear pump, said pressure chambers are delimited with respect to one another in fluid-tight fashion by toothings on the inner and outer parts 41; 42. In the case of a vane-type pump (as shown in FIG. 7), said pressure chambers are delimited with respect to one another in fluid-tight fashion by radially movable vanes 45.

The connection assembly 10 according to the disclosure has the advantage that it can be adapted in a flexible manner to different feed pumps, which differ in particular with regard to the width of the inner and of the outer part 41; 42 in the direction of the axis of rotation 11. Here, the main body 20, the drive shaft 30 and the cover 80 may be of identical form in all structural variants. Differences arise only in the case of the inner and the outer part 41; 42 in order to realize the desired delivery capacity. The internal shape of the receiving part 50 is formed in a correspondingly adapted manner, wherein the external shape of the receiving part 50 is identical in all structural variants.

The inner part 41, the outer part 42 and the receiving part 50 together form a pump assembly 12, wherein all of the stated parts have a common planar sealing surface 13. The receiving part 50 is received in a second recess 22 of the main body, which is preferably of circular cylindrical form with respect to the axis of rotation 11. By means of a cylindrical pin 55, the receiving part 50 is secured against rotation about the axis of rotation 11. In the present case, the sealing surface 13 bears, via a separate closure plate 70, against the planar base of the second recess 22, wherein said sealing surface may also bear directly against said base. The closure plate 70 is formed in the manner of a planar plate of constant thickness, which is composed for example of brass. It is likewise secured against rotation by means of the cylindrical pin 55 (see FIG. 2).

The outer part 42 is received in a first recess 51 in the receiving part 50. The first recess 51 is of circular cylindrical form, wherein it is arranged eccentrically with respect to the axis of rotation 11. In the case of the present internal gear pump, the outer part 42 is received rotatably there. In the case of a vane-type pump, the outer part 42, specifically the stroke ring, is received rotationally fixedly there.

The receiving part 50 is covered at least in certain portions by a cover 80, wherein the cover 80 is screwed to the main body 20. The cover 80 may, as illustrated here, have an opening, such that a through drive to a directly mounted hydraulic machine is possible. The cover may however also be a closed cover. Between the cover 80 and the main body 20, there is installed a sealing ring 81 for preventing an escape of fluid. The elastic element 60 according to the disclosure is installed under preload between the cover 80 and the receiving part 50. The corresponding preload force acts in the direction of the axis of rotation 11, wherein said preload force is supported on the cover 80 and, by way of the physical contact, on the sealing surface 13. The receiving part 50 has, in the direction of the axis of rotation 11, a certain movement clearance in the second recess 22, such that the entire pump assembly 12 with its sealing surface 13 is pressed against the closure plate 70, and this in turn is pressed against the base of the second recess 22. A fluid-tight seal is accordingly provided there.

The cover 80 is, by means of a circular cylindrical centering projection 56, oriented transversely with respect to the axis of rotation 11. In the direction of the axis of rotation 11, said cover bears against a planar surface of the main body 20. In the region of the receiving part 50, the cover 80 is formed with a spacing to the receiving part 50, such that the discussed movement clearance is realized.

Figure 2:
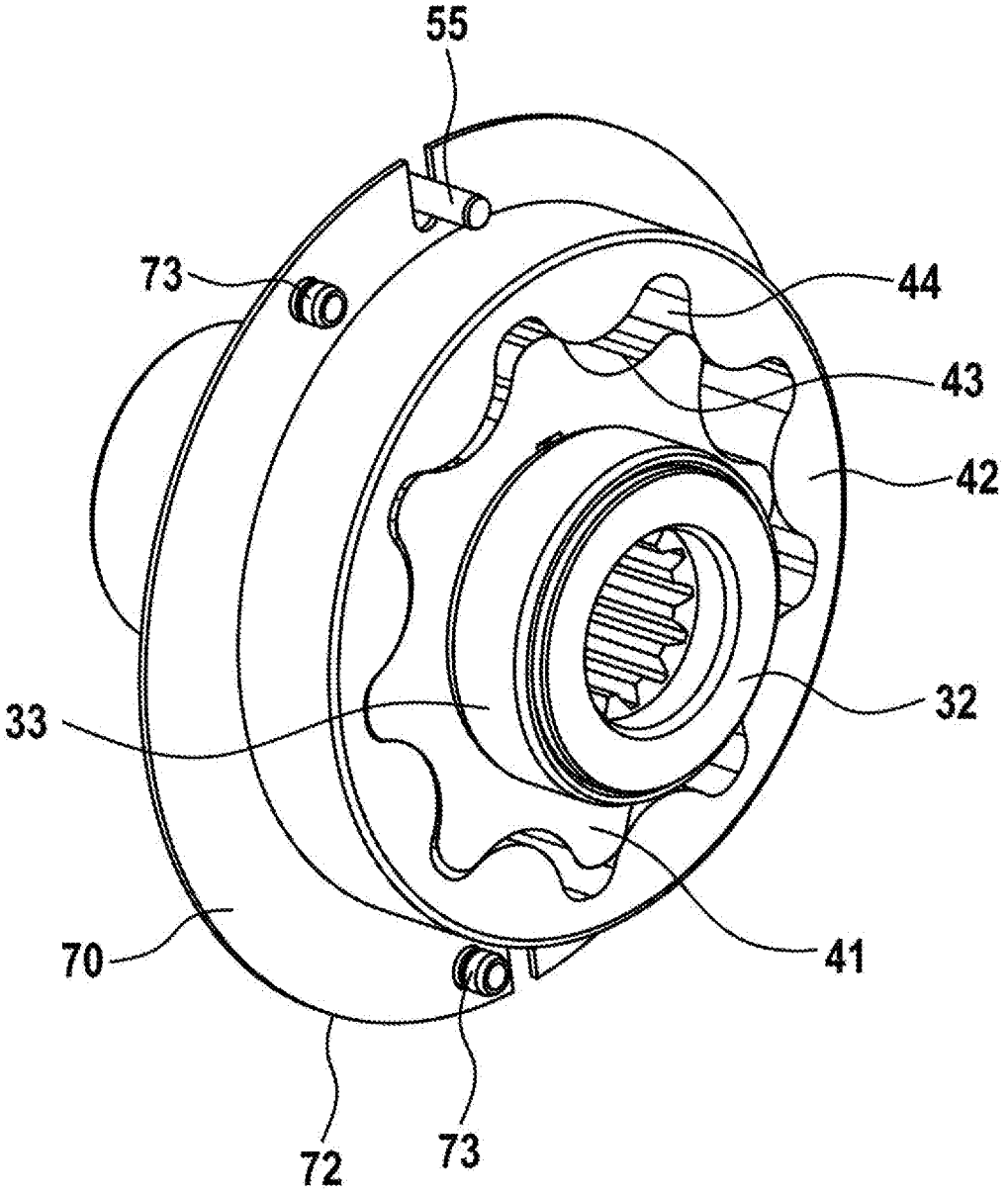
FIG. 2 shows a perspective view of the inner part, of the outer part and of the drive shaft.

FIG. 2 shows a perspective view of the inner part 41, of the outer part 42 and of the drive shaft 30. It is possible to see the external toothing 43 on the inner part 41 and the internal toothing 44 on the outer part 42, which toothings mesh with one another. Opposite the toothing engagement, in each case at least one pair of teeth bear against one another in fluid-tight fashion, resulting in at least two pressure chambers which are delimited with respect to one another in fluid-tight fashion and the volume of which changes when the second shaft part 32 rotates. The second shaft part 32 is supported, rotatably with respect to the axis of rotation, on the main body and on the receiving part (numbers 22; 40 in FIG. 1) by means of two slide rings 33 (see also FIG. 3). It can also be seen how the cylindrical pin 55 engages into a recess on the outer circumference of the closure plate 70 in order to secure the latter against rotation. The outer circumferential surface 72 of the closure plate 70 is of circular cylindrical form with respect to the axis of rotation. With the separate holding plugs 73, the closure plate 70 is oriented transversely with respect to the axis of rotation. Here, the holding plugs 73 engage into respectively associated bores in the closure plate 70 and in the receiving part 50. The pump assembly preferably also comprises the closure plate 70, wherein the latter can be installed as a whole into the main body.

Figure 3:
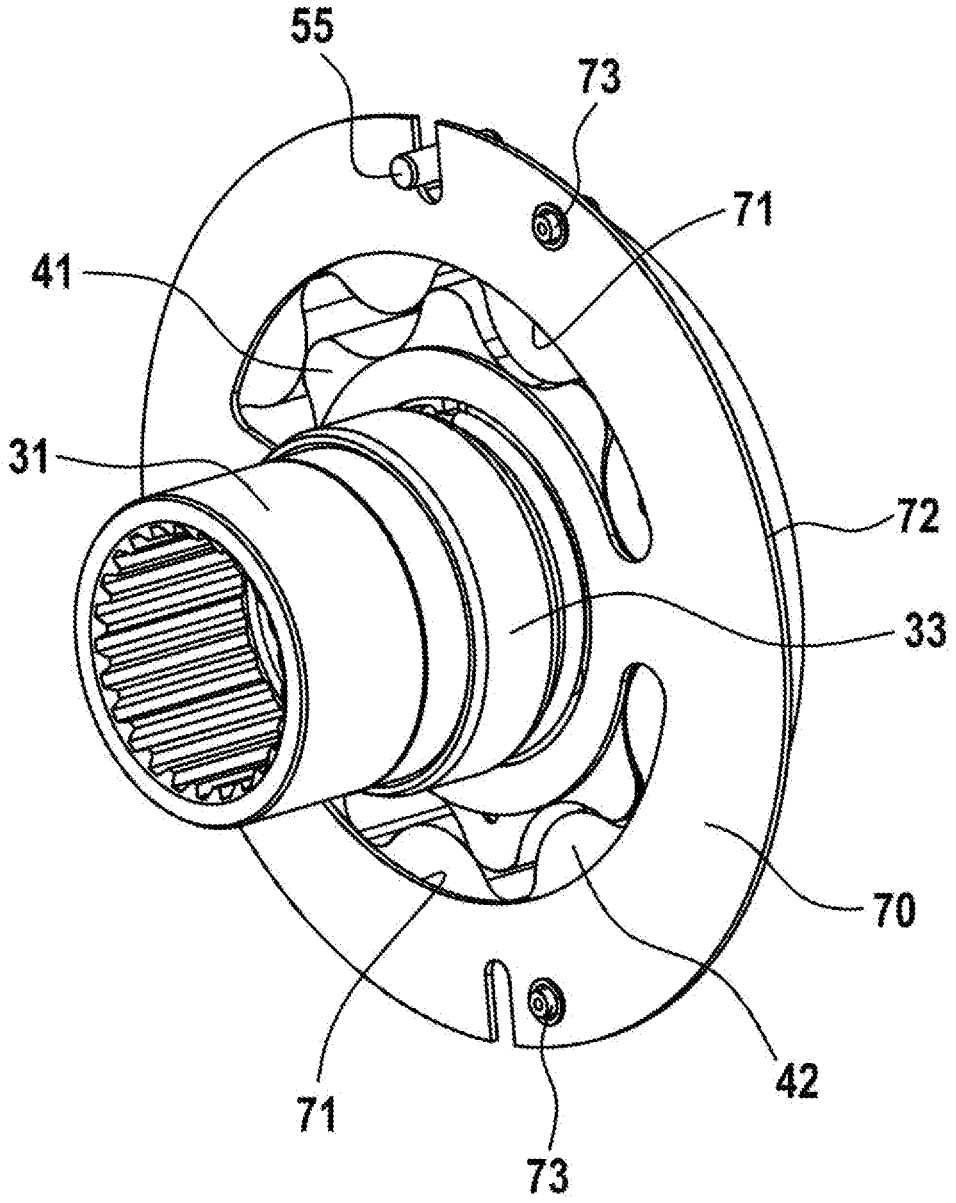
FIG. 3 shows a further perspective view of the assembly as per FIG. 2.

FIG. 3 shows a further perspective view of the assembly as per FIG. 2. It can be seen that the holding plugs 73 project beyond the closure plate 70, wherein said holding plugs bear against the base of the second recess (number 22 in FIG. 1). Furthermore, it is possible to see the two kidney-shaped apertures 71 in the closure plate 70, which apertures are arranged in the region of the toothing engagement between the inner and the outer part 41; 42. One aperture 71 is connected to an associated fluid connection (number 21 in FIG. 1), wherein the other aperture is connected at a suction side to the cylinder drum of the axial piston machine.

Figure 4:
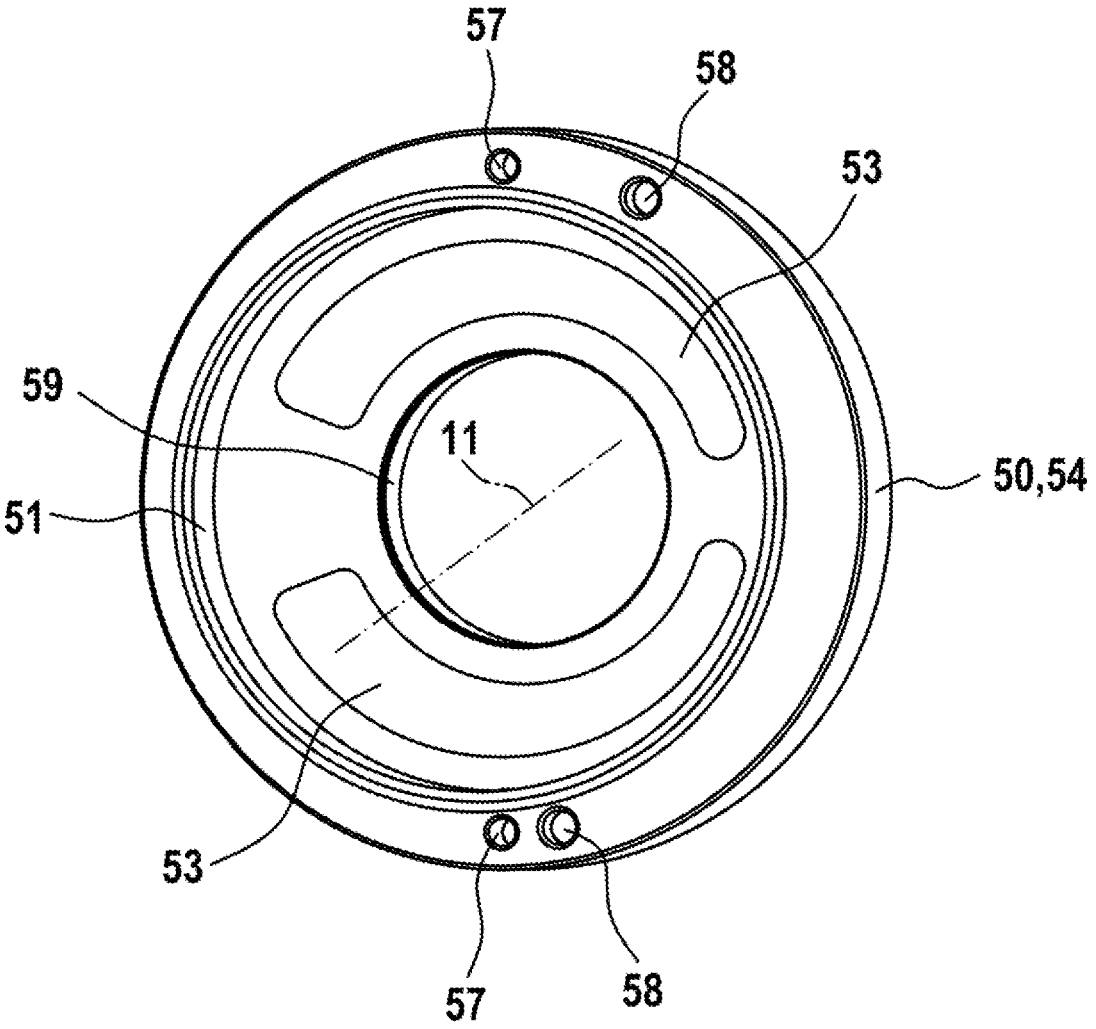
FIG. 4 shows a perspective view of the receiving part.

FIG. 4 shows a perspective view of the receiving part 50 from the side facing toward the main body. The outer circumferential surface 54 and the aperture 59 for the drive shaft are each of circular cylindrical form with respect to the axis of rotation 11. The first recess 51 is likewise of circular cylindrical design, wherein it is arranged eccentrically and parallel with respect to the axis of rotation 11. The end surface of the receiving part 50 is formed so as to be planar and perpendicular to the axis of rotation 11, wherein two bores 57 for the cylindrical pin and two bores 58 for the holding plugs are arranged there.

Reference is also made to the kidney-shaped third recesses 53, which are each arranged in alignment, in the direction of the axis of rotation 11, with an associated aperture on the closure plate. The third recesses 53 have a planar base surface which is oriented perpendicular to the axis of rotation 11. The depth of said third recesses is accordingly constant.

Figure 5:
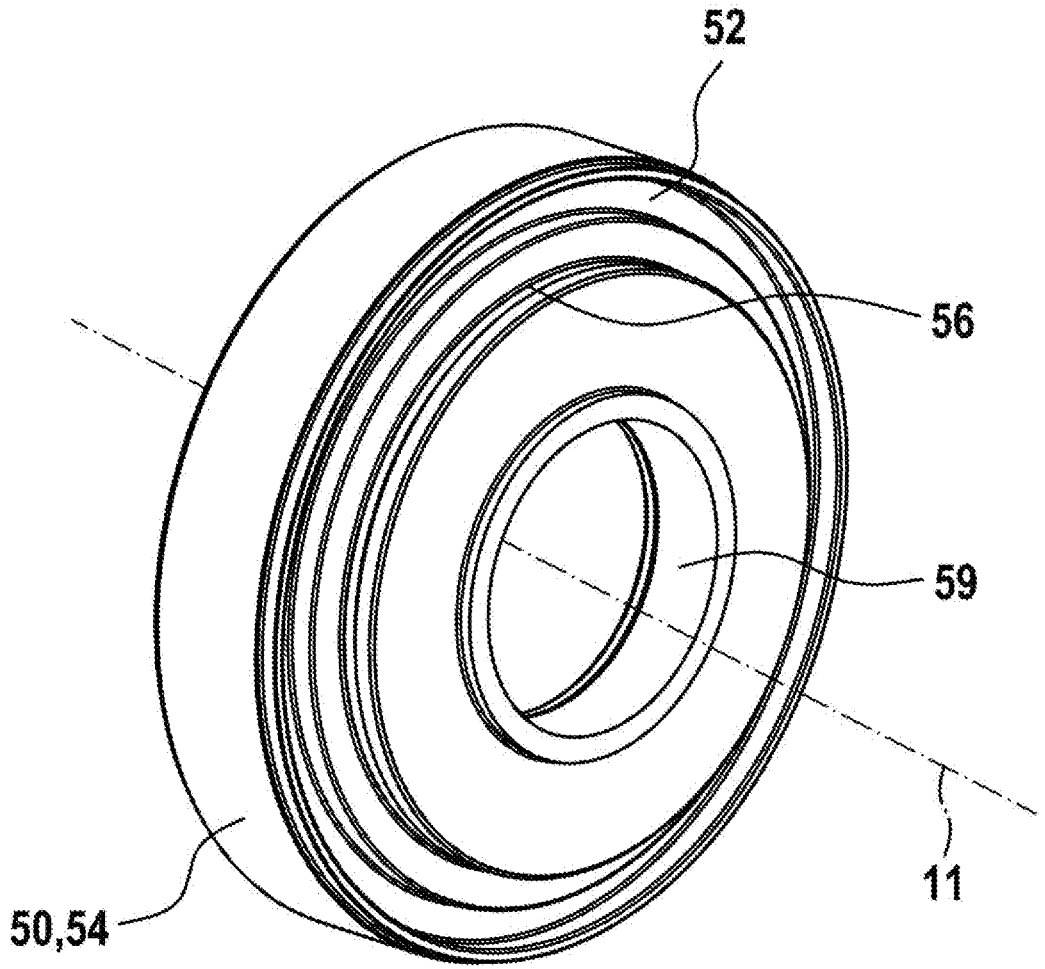
FIG. 5 shows a further perspective view of the receiving part.

FIG. 5 shows a further perspective view of the receiving part 50, from the side facing toward the cover. The centering projection 56 for the cover is of circular cylindrical form with respect to the axis of rotation 11. Furthermore, in that surface of the receiving part 50 which is covered by the cover, there is provided a groove 52 for receiving the elastic element. The groove 52 runs in encircling, circular-ring-shaped fashion around the axis of rotation 11, wherein said groove has a constant depth in the direction of the axis of rotation 11. The groove is arranged as close as possible to the outer circumferential surface 54, such that the elastic element can be designed to be particularly large.

Figure 6:
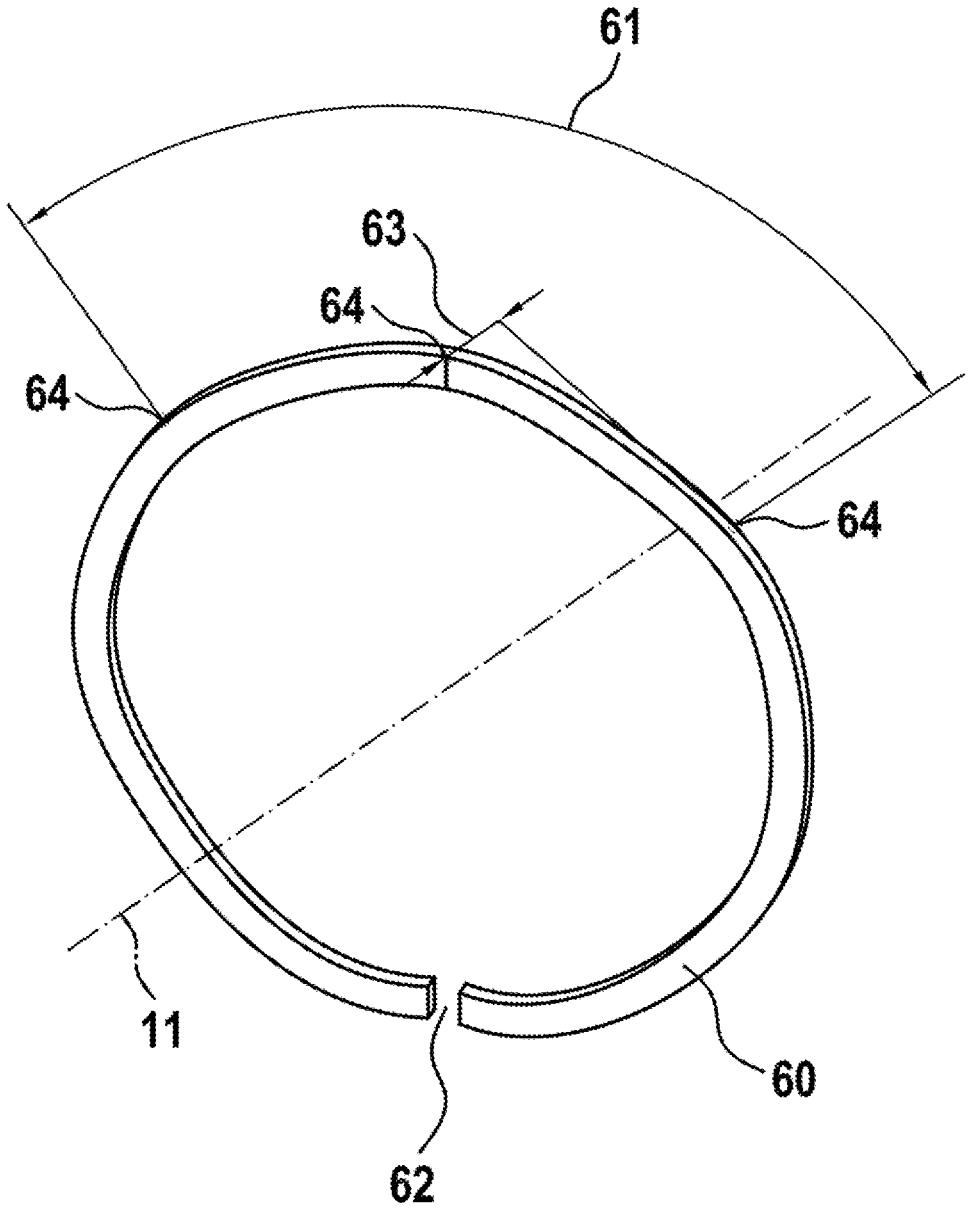
FIG. 6 shows a perspective view of the elastic element.

FIG. 6 shows a perspective view of the elastic element 60. The elastic element 60 is designed as a separate component in the form of an ondular washer. Said elastic element extends in circular-ring-shaped fashion around the axis of rotation 11. In the circumferential direction, said elastic element has a discontinuity 62, such that it is a slotted ring. This has a lower spring stiffness than a closed ring. The elastic element 60 is composed preferably of hardened spring steel. Along its circumference, it has a constant rectangular cross-sectional shape, wherein the relatively short rectangle side is arranged parallel to the axis of rotation 11. In the circumferential direction, the elastic element 60 runs in undulating fashion, such that it bears against the base of the groove (number 52 in FIG. 5) and against the cover (number 80 in FIG. 1) only in each case at multiple contact regions 64 of small area. In the present case, on each side, four contact regions 64 are provided which are arranged in each case at an undulation trough or at an undulation peak. The stiffness of the elastic element is greater the shorter the wavelength or the more contact regions 64 are provided. A contact region 64 is divided by the discontinuity 62 into two parts, such that the two ring ends bear against the associated part there. The height 63 of the elastic element 60 in the direction of the axis of rotation 11, reduced by the thickness of the cross-sectional shape in the direction of the axis of rotation 11, corresponds to the maximum possible spring travel of the elastic element 60. The preload of the elastic element is selected to be of such a magnitude that the hydrostatic forces occurring during operation are reliably exceeded. Consequently, no leaks occur at the sealing surface (number 13 in FIG. 1).

FIG. 6 furthermore shows an undulation portion 61 which is defined by two directly adjacent contact points 64 on one side of the elastic element 60. The stiffness of an undulation portion 61 may be calculated approximately analogously to the stiffness of a centrally loaded straight beam in bending, the length of which is equal to the circumferential length of the undulation portion 61. A more accurate determination of the elasticity of the elastic element 60 is self-evidently possible by means of FEM calculation.

REFERENCE DESIGNATIONS

10 Connection assembly
11 Axis of rotation
12 Pump assembly
13 Sealing surface
20 Main body
21 Fluid connection
22 Second recess
30 Drive shaft
31 First shaft part
32 Second shaft part
33 Slide ring
40 Feed pump
41 Inner part
42 Outer part
43 External toothing of the inner part
44 Internal toothing of the outer part
50 Receiving part
51 First recess
52 Groove (for elastic element)
53 Third recess
54 Outer circumferential surface of the receiving part

55 Cylindrical pin
56 Centering projection
57 Bore for cylindrical pin
58 Bore for holding plug
59 Aperture for drive shaft
60 Elastic element
61 Undulation portion
62 Discontinuity
63 Height of the elastic element
64 Contact region
70 Closure plate
71 Aperture
72 Outer circumferential surface of the closure plate
73 Holding plug
80 Cover
81 Sealing ring

What is claimed is:

1. An assembly for connection to an axial piston machine, the assembly comprising:

a feed pump configured as one of an internal gear pump and a vane pump;

a main body including at least one fluid connection; and a drive shaft operably connected to the axial piston machine and located in the main body so as to be rotatable with respect to an axis of rotation, the feed pump having an inner part and an outer part, the inner part connected rotationally conjointly to the drive shaft, and the outer part annularly surrounding the inner part;

a separate receiving part with a first recess, the outer part and the inner part located in the first recess, such that a pump assembly, comprising the inner part, the outer part, and the separate receiving part, defines a planar sealing surface configured to bear at least indirectly against the main body, the main body having a second recess in which the pump assembly is located;

a separate cover configured to cover the second recess and the pump assembly, the separate cover configured to bear against the main body; and an elastic element installed under preload between the separate cover and the separate receiving part, such that a corresponding preload force is supported at least indirectly on the main body via the planar sealing surface.

2. The assembly according to claim 1, wherein the elastic element is a separate component.

3. The assembly according to claim 2, wherein the elastic element is a single piece.

4. The assembly according to claim 1, wherein the elastic element annularly surrounds the axis of rotation.

5. The assembly according to claim 4, wherein the elastic element is an ondular washer.

6. The assembly according to claim 4, wherein the elastic element is discontinuous in a circumferential direction.

7. The assembly according to claim 4, wherein:

the elastic element is located in a groove in the separate receiving part, and the groove is configured to encircle annularly the axis of rotation.

8. The assembly according to claim 7, wherein a depth of the groove measured in a direction of the axis of rotation is smaller than a corresponding height of the elastic element in an unbraced configuration.

9. The assembly according to claim 1, wherein:

the pump assembly bears, via a separate closure plate, against the main body;

the separate closure plate has at least two apertures each configured to open out between the inner part and the outer part;

the separate closure plate is connected rotationally conjointly to the main body; and at least one aperture of the at least two apertures is fluidically connected to an associated fluid connection.

10. The assembly according to claim 9, wherein an outer circumferential surface of the separate closure plate and an outer circumferential surface of the separate receiving part are aligned with one another in a direction of the axis of rotation.

11. The assembly according to claim 9, wherein at least one aperture of the at least two apertures is fluidically connected to a third recess.

12. A collection comprising:

at least two assemblies, each configured for connection to an axial piston machine and each including:

a feed pump configured as one of an internal gear pump and a vane pump;

a main body including at least one fluid connection; and a drive shaft located in the main body so as to be rotatable with respect to an axis of rotation, the feed pump having an inner part and an outer part, the inner part connected rotationally conjointly to the drive shaft, and the outer part annularly surrounding the inner part;

a separate receiving part with a first recess, the outer part and the inner part located in the first recess such that a pump assembly, comprising the inner part, the outer part, and the separate receiving part, defines a planar sealing surface configured to bear at least indirectly against the main body, the main body having a second recess in which the pump assembly is located;

a separate cover configured to cover the second recess and the pump assembly, the separate cover configured to bear against the main body; and an elastic element is installed under preload between the separate cover and the separate receiving part, such that a corresponding preload force is supported at least indirectly on the main body via the planar sealing surface, wherein the feed pump of a first assembly of the at least two assemblies has first delivery capacity, and wherein the feed pump of a second assembly of the at least two assemblies has a second.

* * * * *